US007310079B2

(12) United States Patent
Chen et al.

(10) Patent No.: US 7,310,079 B2
(45) Date of Patent: Dec. 18, 2007

(54) APPARATUS AND METHOD OF CHARGE SHARING IN LCD

(75) Inventors: Ming-Yeong Chen, Tainan County (TW); Po-Hsien Tsai, Tainan County (TW)

(73) Assignee: Himax Technologies, Inc., Tainan County (TW)

( * ) Notice: Subject to any disclaimer, the term of this patent is extended or adjusted under 35 U.S.C. 154(b) by 725 days.

(21) Appl. No.: 10/883,448

(22) Filed: Jul. 1, 2004

(65) Prior Publication Data

US 2006/0001630 A1 Jan. 5, 2006

(51) Int. Cl.
*G09G 3/36* (2006.01)

(52) U.S. Cl. ..... 345/87; 345/93; 345/96; 345/98; 345/100; 345/103

(58) Field of Classification Search ..... 345/87, 345/93, 96, 98, 100, 103
See application file for complete search history.

(56) References Cited

U.S. PATENT DOCUMENTS 6,977,635 B2 * 12/2005 Ogawa et al. ..... 345/93
2004/0263466 A1 * 12/2004 Song et al. ..... 345/100

* cited by examiner

*Primary Examiner*—Richard Hjerpe
*Assistant Examiner*—Leonid Shapiro
(74) *Attorney, Agent, or Firm*—Thomas, Kayden, Horstemeyer & Risley

(57) ABSTRACT

A method for charge sharing between source lines of a pixel array. The method includes the steps of grouping the source lines into pairs, implementing charge sharing if data polarities of a currently and a last scanned row are different; otherwise, in each pair of the source lines, estimating a first and second energy driving the two source lines respectively with and without a preliminary charge sharing, and implementing charge sharing only if the first energy is smaller than the second energy.

19 Claims, 9 Drawing Sheets

Current Frame

| | DL#1 | DL#2 | DL#3 | DL#4 |
|---|---|---|---|---|
| GL#1 | + | + | + | + |
| GL#2 | + | + | + | + |
| GL#3 | + | + | + | + |
| GL#4 | + | + | + | + |

+Positive Video Signal

Next Frame

| | DL#1 | DL#2 | DL#3 | DL#4 |
|---|---|---|---|---|
| GL#1 | − | − | − | − |
| GL#2 | − | − | − | − |
| GL#3 | − | − | − | − |
| GL#4 | − | − | − | − |

−Negative Video Signal

FIG 1A

Current Frame

| | DL#1 | DL#2 | DL#3 | DL#4 |
|---|---|---|---|---|
| GL#1 | + | + | + | + |
| GL#2 | − | − | − | − |
| GL#3 | + | + | + | + |
| GL#4 | − | − | − | − |

+Positive Video Signal

Next Frame

| | DL#1 | DL#2 | DL#3 | DL#4 |
|---|---|---|---|---|
| GL#1 | − | − | − | − |
| GL#2 | + | + | + | + |
| GL#3 | − | − | − | − |
| GL#4 | + | + | + | + |

−Negative Video Signal

FIG 1B

Current Frame

| | DL#1 | DL#2 | DL#3 | DL#4 |
|---|---|---|---|---|
| GL#1 | + | − | + | − |
| GL#2 | + | − | + | − |
| GL#3 | + | − | + | − |
| GL#4 | + | − | + | − |

+Positive Video Signal

Next Frame

| | DL#1 | DL#2 | DL#3 | DL#4 |
|---|---|---|---|---|
| GL#1 | − | + | − | + |
| GL#2 | − | + | − | + |
| GL#3 | − | + | − | + |
| GL#4 | − | + | − | + |

−Negative Video Signal

FIG 1C

Current Frame

| | DL#1 | DL#2 | DL#3 | DL#4 |
|---|---|---|---|---|
| GL#1 | + | − | + | − |
| GL#2 | − | + | − | + |
| GL#3 | + | − | + | − |
| GL#4 | − | + | − | + |

+Positive Video Signal

Next Frame

| | DL#1 | DL#2 | DL#3 | DL#4 |
|---|---|---|---|---|
| GL#1 | − | + | − | + |
| GL#2 | + | − | + | − |
| GL#3 | − | + | − | + |
| GL#4 | + | − | + | − |

−Negative Video Signal

FIG 1D

APPARATUS AND METHOD OF CHARGE SHARING IN LCD

BACKGROUND OF THE INVENTION

1. Field of the Invention

The present invention relates to driving an LCD and particularly to an apparatus and method for charge sharing between source lines of the pixel array in a TFT-LCD.

2. Description of the Related Art

In general, a conventional TFT-LCD is operated by providing positive and negative video signals alternately to the liquid crystal on the basis of VCOM, however, resulting in flicker. To reduce the generation of flicker, a conventional TFT-LCD is employed one of a frame inversion, line inversion, column inversion and dot inversion shown in FIGS. 1A to 1D, respectively.

The frame inversion of FIG. 1A is a mode that the polarity of the video signal changed only when the frame is changed. The line inversion of FIG. 1B is a mode that the video signal's polarity is varied whenever the gate line GL changes. The column inversion shown in FIG. 1C converts the polarity of the video signal whenever the source line DL changes, and the dot inversion of FIG. 1D converts it whenever the source line DL, gate line GL and frame change. The image quality is satisfactory in the order of the frame inversion, line inversion, column inversion and dot inversion. When convert the video signal's polarity from positive to negative or from negative to positive, it cause power consumption. Therefore, the dot inversion causes higher power consumption.

FIG. 2 illustrate the video signal's polarity conversion in the conventional TFT-LCD. In FIG. 2, the video signal of two adjacent source line DL#1 and DL#2 convert polarity during asserted period of control signal TP. By doing so, the video signal of source line DL#1 is converted from positive polarity (the voltage level of video signal higher than the voltage level of VCOM) to negative polarity (the voltage level of video signal lower than the voltage level of VCOM). The video signal of source line DL#2 is converted from negative polarity to positive polarity. When polarity converts, large range of voltage level change occurs. Because power consumption has direct ratio to the voltage level change, larger range of voltage level change causes higher power consumption.

SUMMARY OF THE INVENTION

The object of the present invention is to provide an apparatus and method for charge sharing in an LCD, which is an optimum approach to reduce power consumption when an inversion of any number of lines is employed.

The present invention provides a method for driving an LCD including the steps of scanning rows of a pixel array by sequentially asserting gate lines thereof, receiving a polarity signal indicating data polarities of the rows, determining first levels of voltages on source lines of the pixel array for the scanned rows according to pixel data and the data polarities thereof, grouping the source lines of the pixel array into pairs, in a charge sharing period, and if the data polarities of the currently and last scanned rows are different, coupling the two source lines in each pair; otherwise, in each pair of the source lines, estimating common voltage level on the two source lines for the last scanned rows if the two source lines are coupled, estimating a first value of energy driving the voltages on the two source lines from the common voltage level to the first levels for the currently scanned row, estimating a second value of energy driving the voltages on the two source lines from the first levels for the last scanned row to those for the currently scanned row, and coupling the two source lines if the first value is smaller than the second value, and in a data period, decoupling the two source lines in each pair and driving the voltages thereon to the first levels for the currently scanned row.

The present invention provides another method for charge sharing between source lines of a pixel array. The method includes the steps of grouping the source lines into pairs, if data polarities of a currently and last scanned row of the pixel array are different, coupling the two source lines in each pair during a charge sharing period; otherwise, in each pair of the source lines, estimating a common voltage level on the two source lines for the last scanned row if the two source lines are coupled, estimating a first value of energy driving the voltages on the two source lines from the common voltage level to levels of data for the currently scanned row, estimating a second value of energy driving the voltages on the two source lines from the levels of the data for the last scanned row to those for the currently scanned row, and coupling together the two source lines during the charge sharing period if the first value is smaller than the second value, and decoupling the two source lines in each pair during a data period.

The present invention further provides an apparatus for charge sharing between source lines of a pixel array in an LCD, including a plurality of switches, each of which is coupled between two of the source lines so that the source lines are grouped into pairs, and a control circuit implementing the steps of closing all the switches during a charge sharing period if data polarities of a currently and last scanned row of the pixel array are different; otherwise, in each pair of the source lines, estimating a common voltage level on the two source lines if the switch coupled therebetween are closed, estimating a first value of energy driving the voltages on the two source lines from the common voltage level to levels of data for the currently scanned row, estimating a second value of energy driving the voltages on the two source lines from the levels of the data for the last scanned row to those for the currently scanned row, and closing the switch coupled between the two source lines during the charge sharing period if the first value is smaller than the second value, and opening all the switches during a data period.

BRIEF DESCRIPTION OF THE DRAWINGS

The present invention will become more fully understood from the detailed description given hereinbelow and the accompanying drawings, given by way of illustration only and thus not intended to be limitative of the present invention.

FIGS. 1A~1D respectively show a frame inversion, line inversion, column inversion and dot inversion employed in the conventional TFT-LCD.

DETAILED DESCRIPTION OF THE INVENTION

Figure 2:
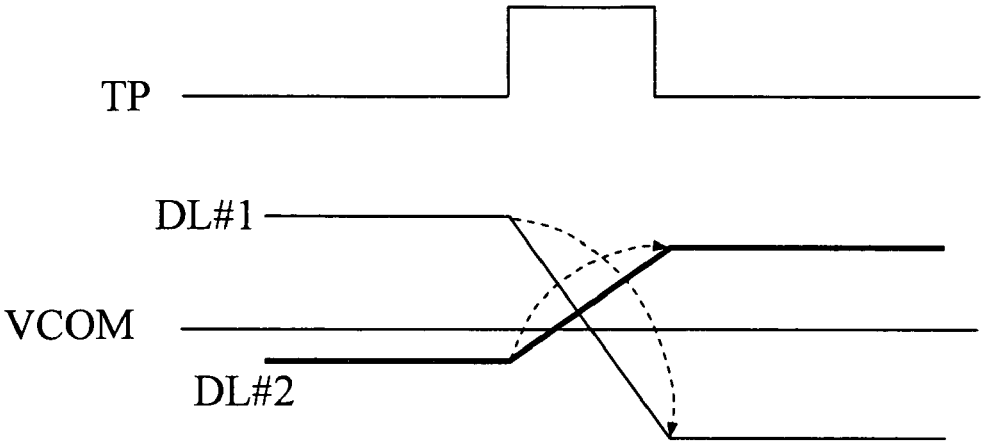
FIG. 2 illustrate the video signal's polarity conversion in the conventional TFT-LCD.
Figure 3:
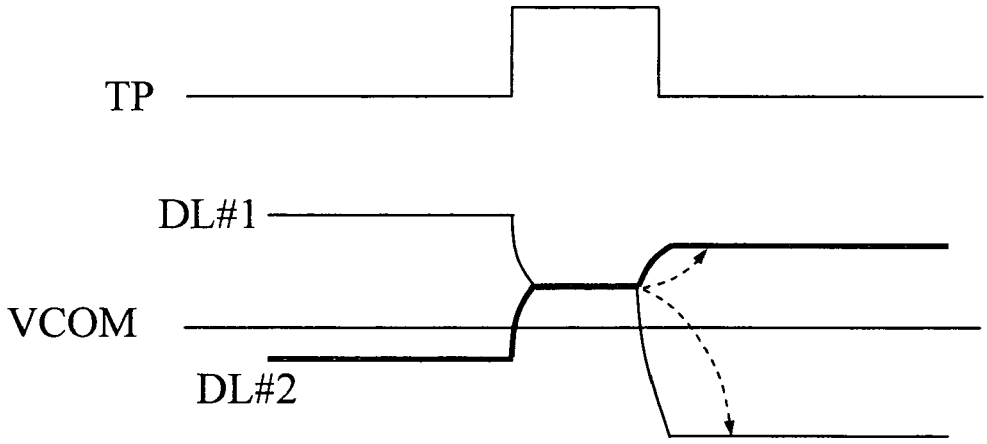
FIG. 3 illustrate the video signal's polarity conversion with charge sharing in a TFT-LCD.

FIG. 3 illustrate the video signal's polarity conversion with charge sharing in a TFT-LCD. In FIG. 3, the video signal of two adjacent source line DL#1 and DL#2 convert polarity with charge sharing during asserted period of control signal TP. The video signal of source line DL#1 and DL#2 are applied charge sharing and the voltage levels of the source line DL#1 and DL#2 both becomes a common voltage level, an average voltage level of the source line DL#1 and DL#2. The video signal of source line DL#1 is converted from positive polarity to negative polarity through the common voltage level, the video signal of source line DL#2 is converted from negative polarity to positive polarity through the common voltage level. Only the voltage range from the common voltage level to negative polarity of source line DL#1 and the voltage range from the common voltage level to positive polarity of source line DL#2 are needed to be driven. Because of smaller range of voltage level change, lower power consumption can be achieved.

Figure 4:
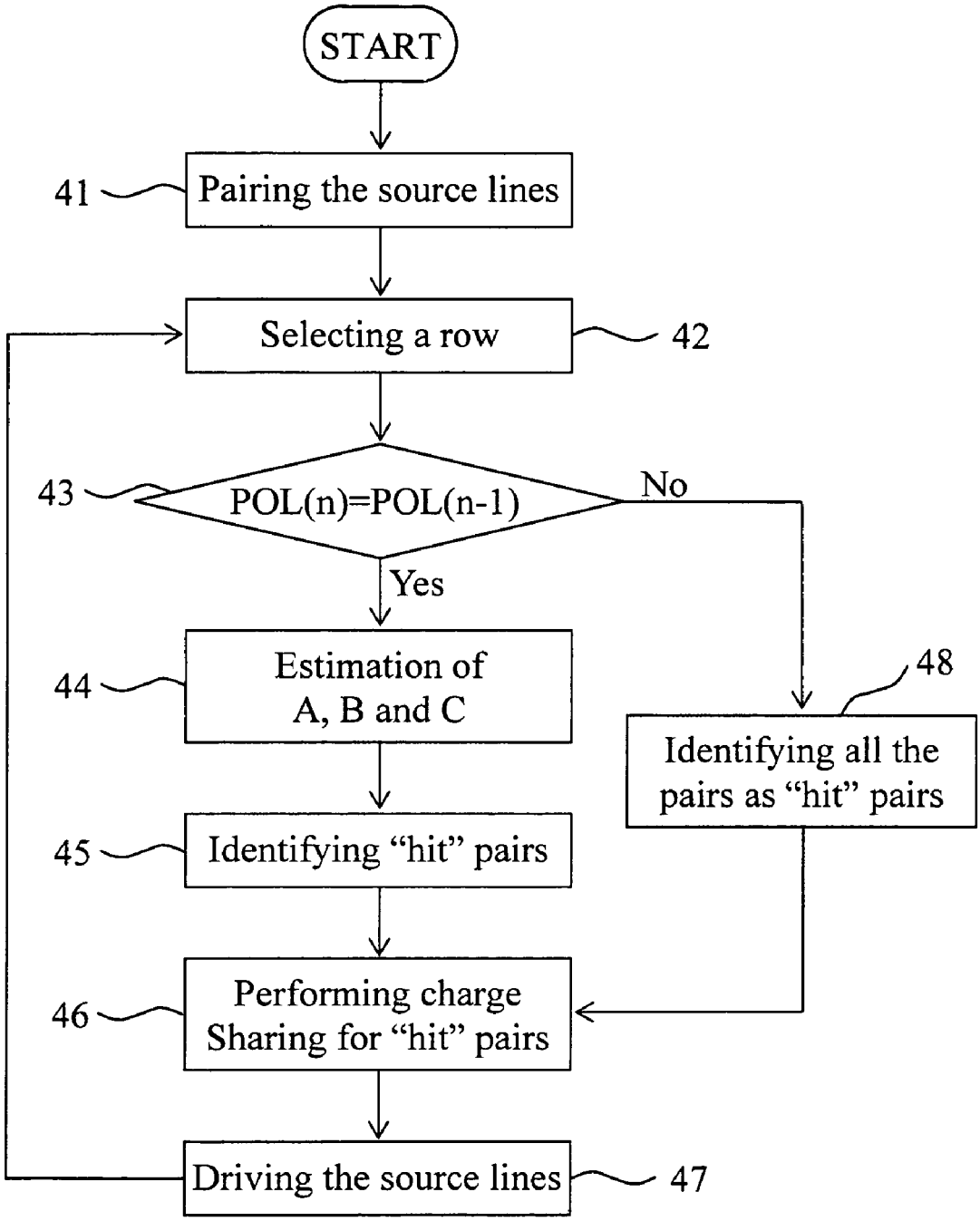
FIG. 4 is a flowchart of a method for charge sharing between source lines of a pixel array in a TFT-LCD according to one embodiment of the invention.

FIG. 4 is a flowchart of a method for charge sharing between source lines of a pixel array in a TFT-LCD according to one embodiment of the invention.

In step 41, the source lines are grouped into pairs. Each pair of odd and even numbered source lines adjacent to each other is a charge sharing unit.

In step 42, one of the rows of the pixel array is scanned (selected). For example, the $n^{th}$ row is currently scanned.

In step 43, by receiving a polarity signal indicating data polarities of the rows, it is determined for each source line pair whether the data polarities of the currently ($n^{th}$) and the last scanned ($(n-1)^{th}$) row of the pixel array are different. If so the procedure goes to step 48 wherein all the source line pairs are identified as "hit" pairs; otherwise, the procedure goes to step 44.

In step 44, in each source line pair, a common voltage level on the two source lines is estimated if the two source lines are coupled. The common voltage level may be estimated by averaging the levels of the data appearing on the two source lines for the last scanned row, which is illustrated by the following equation:

$$A = \frac{X_{2k,n-1} + X_{2k+1,n-1}}{2}$$

where A is the estimated common voltage level, $X_{2k,n-1}$ is the level of the data appearing on the $2k^{th}$ source line (the even numbered source line in the $k^{th}$ pair) for the $(n-1)^{th}$ (last scanned) row, and $X_{2k+1,n-1}$ is the level of the data appearing on the $(2k+1)^{th}$ source line (the odd numbered source line in the $k^{th}$ pair) for the $(n-1)^{th}$ (last scanned) row.

In each source line pair, a first value of energy driving the voltages on the two source lines from the common voltage level to levels of data to be applied for the currently scanned row is estimated. A second value of energy driving the voltages on the two source lines from the levels of the data appearing on the two source lines for the last scanned row to those to be applied for the currently scanned row is also estimated.

The first value may be estimated by summation of two absolute differences respectively between the common voltage level and the two levels of the data for the currently scanned row, which is illustrated by the following equation:

$$B=|X_{2k,n}-A|+|X_{2k+1,n}-A|$$

where B is the estimated first value, $X_{2k,n}$ is the level of the data appearing on the $2k^{th}$ source line for the $n^{th}$ (currently scanned) row, and $X_{2k+1,n}$ is the level of the data appearing on the $(2k+1)^{th}$ source line for the $n^{th}$ row. The second value may be estimated by summation of two absolute differences respectively between the levels of the data for the currently and the last scanned row, which is illustrated by the following equation:

$$C=|X_{2k,n}-X_{2k,n-1}|+|X_{2k+1,n}-X_{2k+1,n-1}|$$

In step 45, it is determined for each source line pair whether the first value B is smaller than the second value C. If so, the source line pair is a "hit" pair.

In step 46, during a charge sharing period, the two source lines in each "hit" pair are coupled.

In step 47, during a data period immediately after the charge sharing period, the two source lines in each "hit" pair are decoupled, and the voltages on all the source lines are driven to the levels of data for the currently scanned row.

After step 47, the procedure goes back to step 42 for a next scanned row.

The step 42 can go to the step 44 and ignore the step 43 and the step 48.

The method shown in FIG. 4 will be explained more specifically in the following with reference to FIGS. 5A and 5B.

Figure 5A:
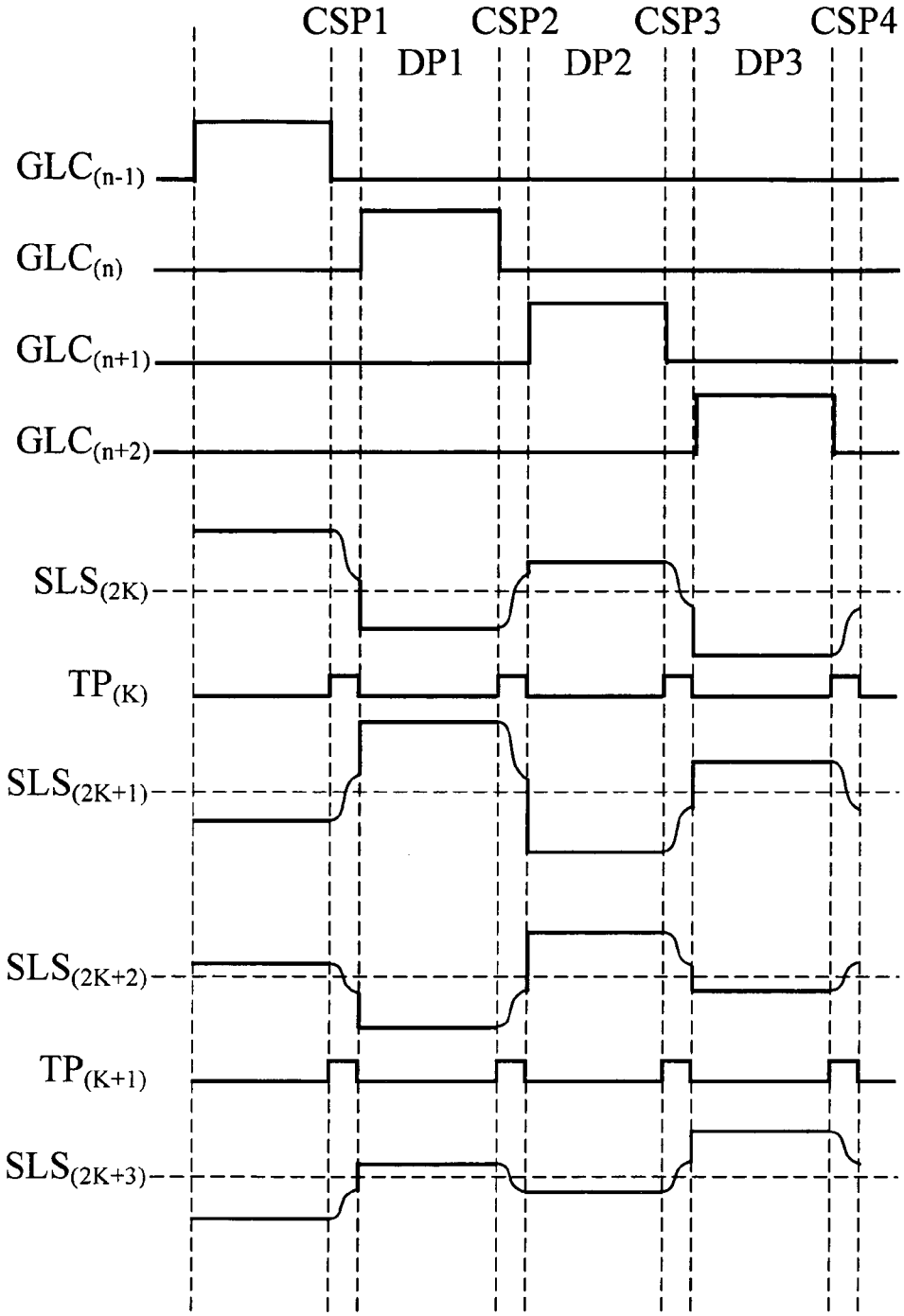
FIGS. 5A, 5B and 5C are diagrams showing timing of the signals used in the TFT-LCD for illustration of the method is shown in FIG. 4.
Figure 5B:
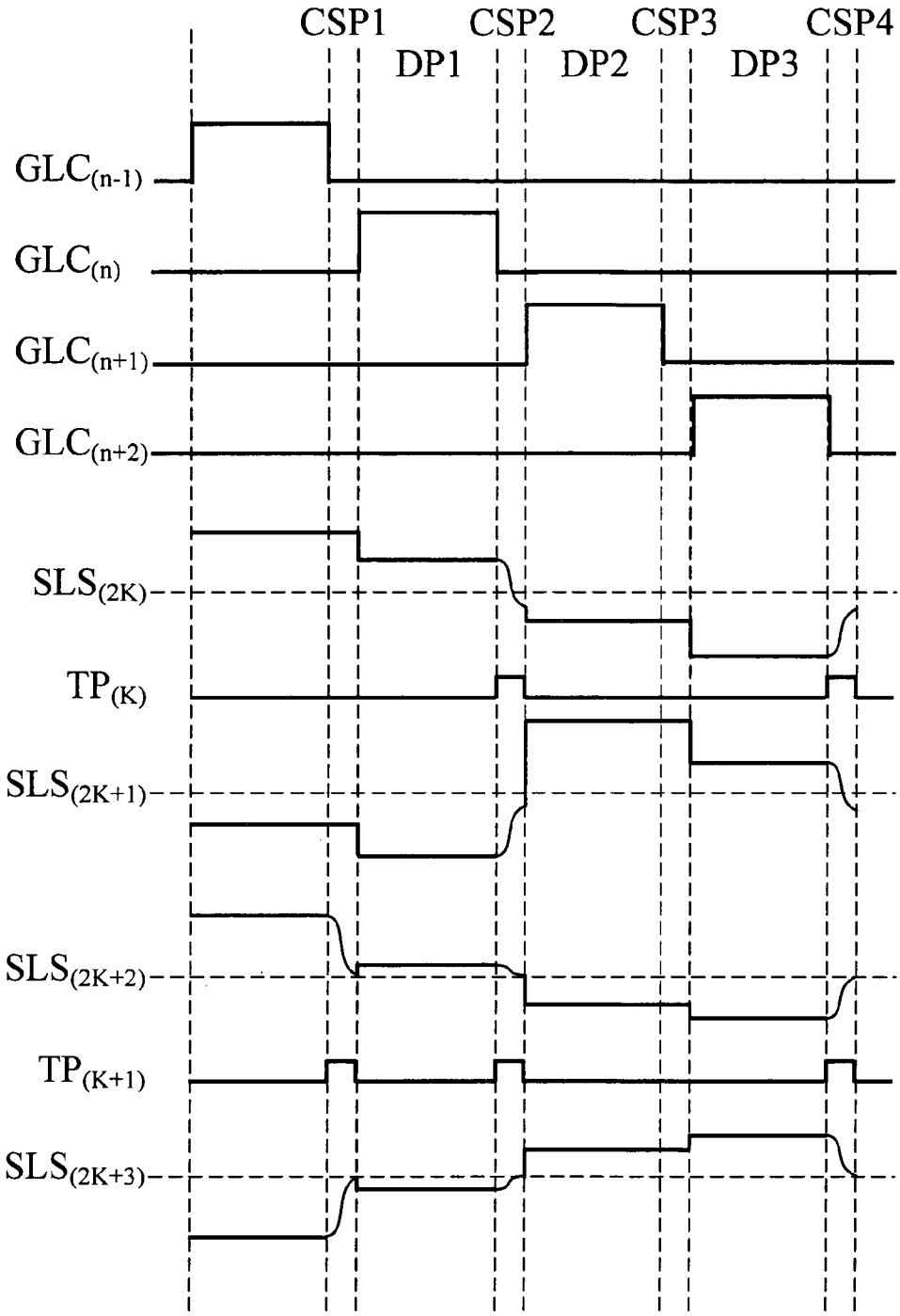
Figure 5C:
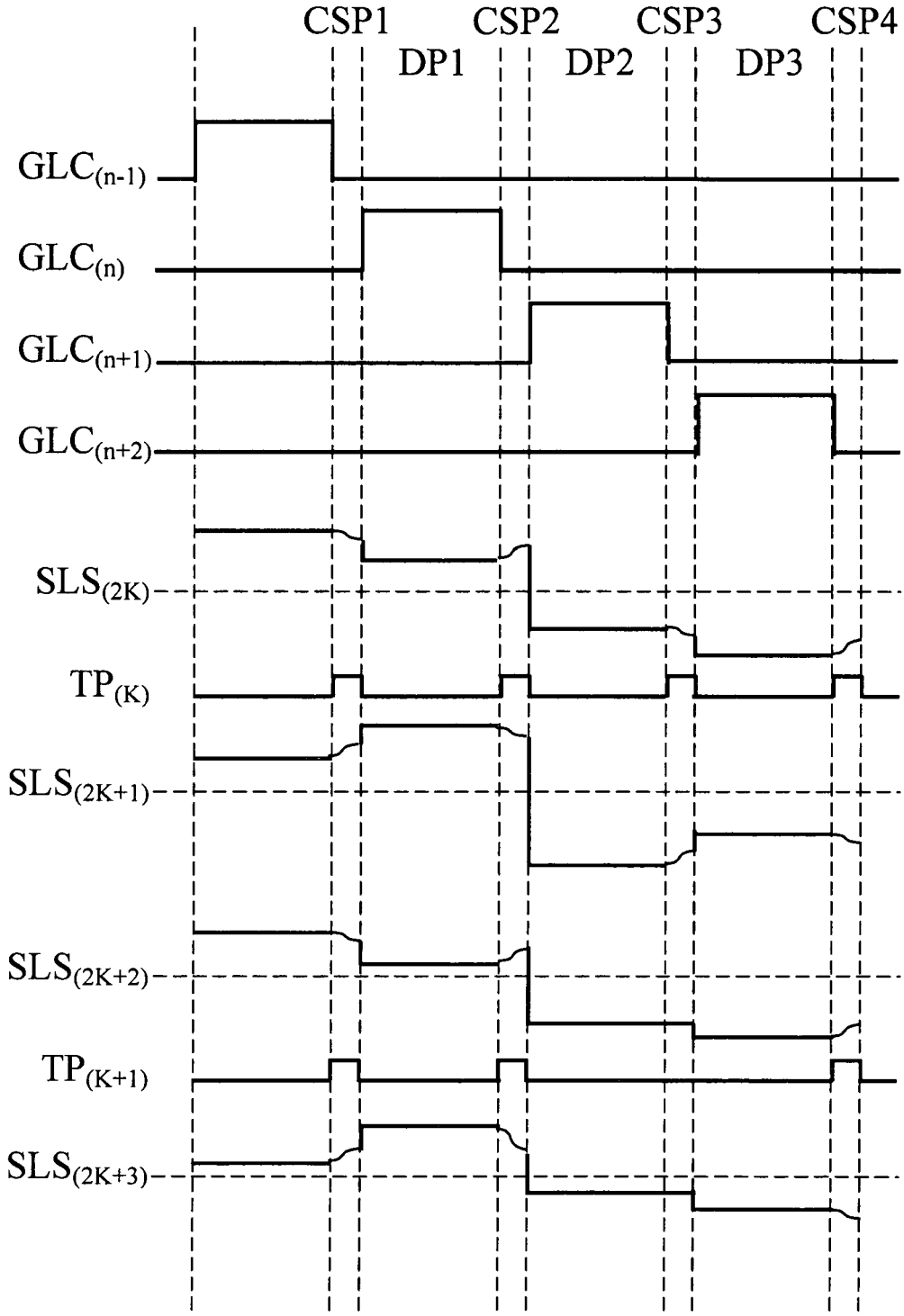

FIGS. 5A, 5B and 5C show the waveforms of the signals respectively when dot, 2-line dot inversions and 2 line inversion are employed. The signals $GLS_{(n-1)}$, $GLS_{(n)}$, $GLS_{(n+1)}$ and $GLS_{(n+2)}$ are gate line signals respectively of the $(n-1)^{th}$, $n^{th}$, $(n+1)^{th}$ and $(n+2)^{th}$ rows of the pixel array. The signals $SLS_{(2k)}$, $SLS_{(2k+1)}$, $SLS_{(2k+2)}$, and $SLS_{(2k+3)}$ are source line signals respectively of the $2k^{th}$, $(2k+1)^{th}$, $(2k+2)^{th}$ and $(2k+3)^{th}$ columns of the pixel array. The $2k^{th}$ and $(2k+1)^{th}$ source lines are put in the $k^{th}$ pair, and the coupling thereof is accomplished by a switch controlled by the signal $TP_{(k)}$ while the $(2k+2)^{th}$ and $(2k+3)^{th}$ source lines are put in the $(k+1)^{th}$ pair, and the coupling thereof is accomplished by a switch controlled by the signal $TP_{(k+1)}$.

In FIG. 5A, since the dot inversion is employed, the data polarity alternates upon each transition of the scanned row and the column of the pixel array. That is to say, the data polarities of the currently and the last scanned rows must be different, and the data polarities of the source lines in each pair also must be different each other. Thus, in each of the charge sharing periods CSP1, CSP2, CSP3 and CSP 4 respectively before data periods DP1, DP2, DP3 and DP4 (not shown), the signals $TP_{(k)}$ and $TP_{(k+1)}$ are asserted to close the switches so that the two source lines in each pair are coupled.

In FIG. 5B, since the 2-line dot inversion is employed, the data polarity alternates between positive polarity and negative polarity upon every two scanned rows and every columns of the pixel array. That is to say, the data polarity alternates every two scanned rows, and the data polarities of the source lines in each pair must be different each other. Because the data polarity alternates every two scanned rows, the signals $TP_{(k)}$ and $TP_{(k+1)}$ must be asserted in the charge sharing period which the data polarity alternates, for example, the charge sharing period CSP2. Others, the assertion of the signals $TP_{(k)}$ and $TP_{(k+1)}$ depend on the relationship between the estimated value B and C in the previous equations. As shown in FIG. 5B, the signal $TP_{(k)}$ is asserted in the charge sharing periods CSP2 and CSP4, but the signal $TP_{(k+1)}$ is asserted in the periods CSP1, CSP2 and CSP4.

In FIG. 5C, since the 2-line inversion is employed, the data polarity alternates between positive polarity and negative polarity upon every two scanned rows. Because the data polarity alternates every two scanned rows, the signals $TP_{(k)}$ and $TP_{(k+1)}$ must be asserted in the charge sharing period which the data polarity alternates, for example, the charge sharing period CSP2. The assertion of the signals $TP_{(k)}$ and $TP_{(k+1)}$ depend on the relationship between the estimated value B and C in the previous equations. As shown in FIG. 5C, the signal $TP_{(k)}$ is asserted in the charge sharing periods CSP1, CSP2, CSP3 and CSP4, but the signal $TP_{(k+1)}$ is asserted in the periods CSP1, CSP2 and CSP4.

Figure 6:
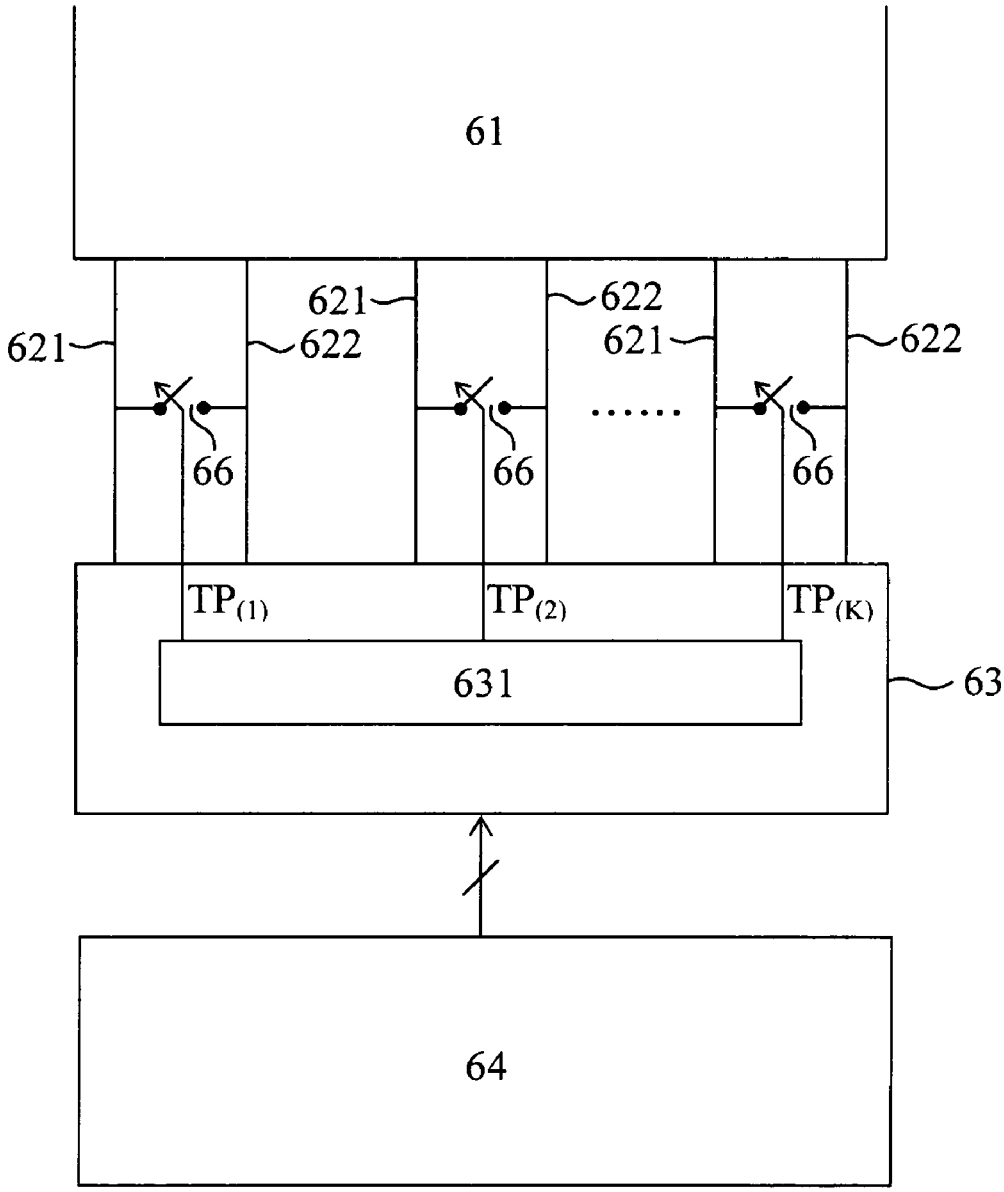
FIG. 6 is a block diagram showing the apparatus for charge sharing between source lines of a pixel array in a TFT-LCD according to one embodiment of the invention.

FIG. 6 is a block diagram showing the apparatus for charge sharing between source lines of a pixel array in a TFT-LCD according to one embodiment of the invention. The TFT-LCD includes a pixel array 61 having odd-numbered source lines 621 and even-numbered source lines 622, a source driver 63, and a controller 64. The charge sharing apparatus includes a control circuit 631 in the source driver 63, and switches 66 coupled between the source lines 621 and 622. The switches 66 are controlled by signals TP (signals $TP_{(1)}$ to $TP_{(K)}$) output from the control circuit 631. For each scanned row, the control circuit 631 implements the steps of:

a) if data polarities of the currently and the last scanned row of the pixel array 61 are different, asserting all the signals TP during a charge sharing period;

b) otherwise, in each pair of the source lines 621 and 622, estimating a common voltage level on the two source lines 621 and 622 if the switch 66 coupled therebetween is closed, estimating a first value of energy driving the voltages on the two source lines 621 and 622 from the common voltage level to levels of data for the currently scanned row, estimating a second value of energy driving the voltages on the two source lines 621 and 622 from the levels of the data for the last scanned row to those for the currently scanned row, and asserting the signal TP controlling the switch 66 coupled between the two source lines 621 and 622 during the charge sharing period if the first value is smaller than the second value, wherein it should be noted that the signals TP (signals $TP_{(1)}$ to $TP_{(K)}$) are not limited to be all asserted, that is to say, some of the signals TP ($TP_{(1)}$ to $TP_{(K)}$) may be de-asserted; and c) de-asserting all the signals TP controlling the switches 66 during a data period after the charge sharing period.

Figure 7:
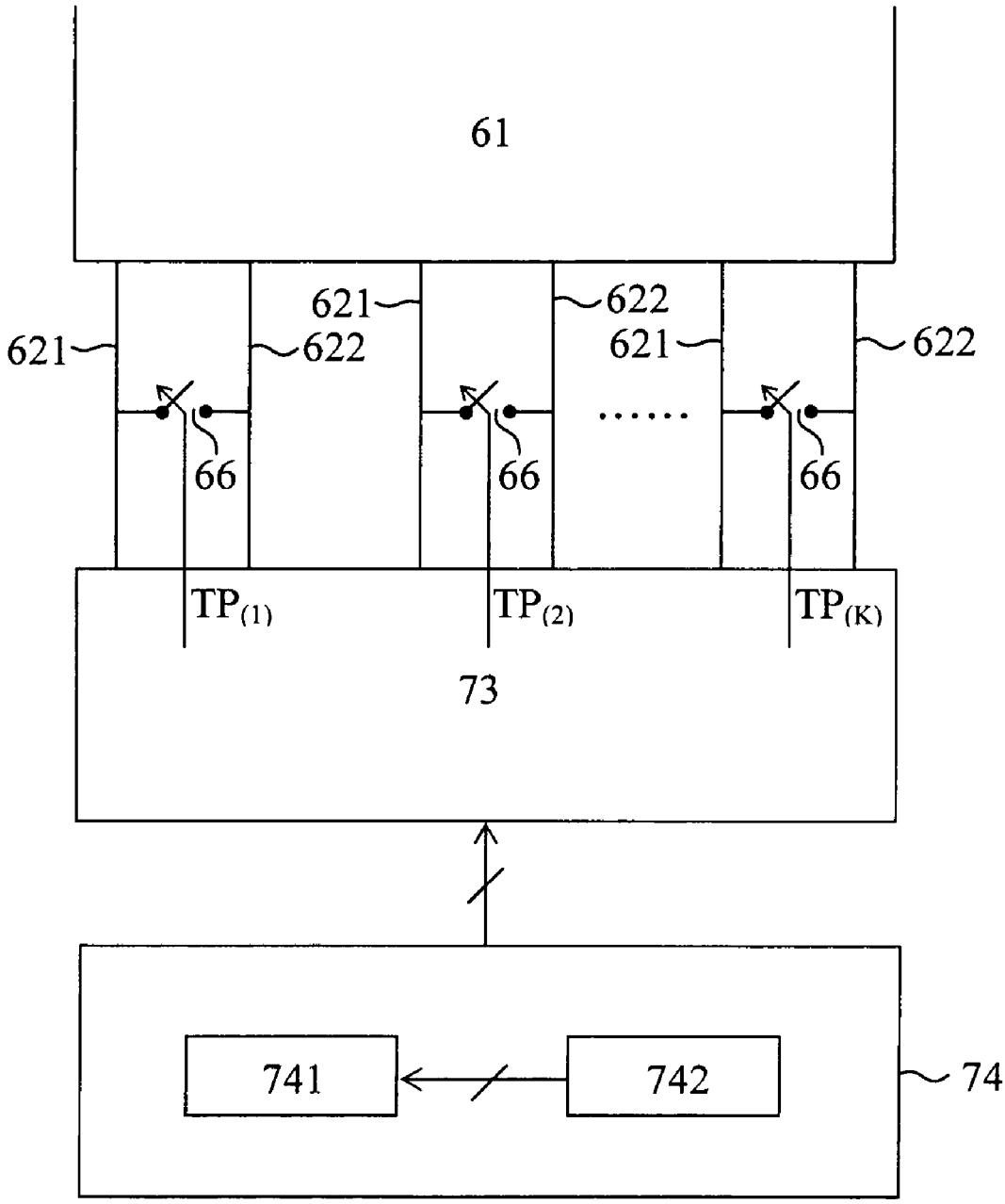
FIG. 7 is a block diagram showing the apparatus for charge sharing between source lines of a pixel array in a TFT-LCD according to another one embodiment of the invention.

FIG. 7 is a block diagram showing the apparatus for charge sharing between source lines of a pixel array in a TFT-LCD according to another embodiment of the invention. The same elements in FIGS. 6 and 7 refer to the same symbols for clarity. It is noted that the control circuit 741 is disposed in the controller 74 rather than the source driver 73 and a memory 742 is specifically shown in the controller 742. Memory 742 may be a ROM (read only memory). Since the controller 74 only handles digital values, the memory 742 must store a look-up table mapping the digital values to analog voltage levels actually appearing on the source lines 721 and 722 for estimation of A, B and C in the previous equation. The source driver 73 generates the signals TP (signals $TP_{(1)}$ to $TP_{(K)}$) according to the estimation results of the control circuit 741 in the controller 74.

In conclusion, the present invention provides an apparatus and method for charge sharing in an LCD, which is an optimum approach to reduction of power consumption when an inversion of any number of lines is employed. Charge sharing of a source line pair is performed only if it reduces the power consumption in driving the two source lines of the pair rather than upon each transition of the scanned row.

The foregoing description of the preferred embodiments of this invention has been presented for purposes of illustration and description. Obvious modifications or variations are possible in light of the above teaching. The embodiments were chosen and described to provide the best illustration of the principles of this invention and its practical application to thereby enable those skilled in the art to utilize the invention in various embodiments and with various modifications as are suited to the particular use contemplated. All such modifications and variations are within the scope of the present invention as determined by the appended claims when interpreted in accordance with the breadth to which they are fairly, legally, and equitably entitled.

What is claimed is:

1. A method for driving an LCD comprising the steps of:

scanning rows of a pixel array by sequentially asserting gate lines thereof;

receiving a polarity signal indicating data polarities of the rows;

determining first levels of voltages on source lines of the pixel array for the scanned rows according to pixel data and the data polarities thereof;

grouping the source lines of the pixel array into pairs;

in a charge sharing period, if the data polarities of the currently and the last scanned rows are different, coupling together the two source lines in each pair;

otherwise, in each pair of the source lines, estimating a common voltage level on the two source lines if the two source lines are coupled;

estimating a first value of energy driving the voltages on the two source lines from the common voltage level to the first levels for the currently scanned row;

estimating a second value of energy driving the voltages on the two source lines from the first levels for the last scanned row to those for the currently scanned row; and coupling the two source lines if the first value is smaller than the second value; and in a data period, decoupling the two source lines in each pair and driving the voltages thereon to the first levels for the currently scanned row.

2. The method as claimed in claim 1, wherein, in each source line pair, the common voltage level is estimated by averaging the first levels of the two source lines for the last scanned row.

3. The method as claimed in claim 1, wherein, in each source line pair, the first value is estimated by summation of two absolute differences respectively between the common voltage level and the two first levels of the two source lines for the currently scanned row.

4. The method as claimed in claim 1, wherein, in each source line pair, the second value is estimated by summation of two absolute differences respectively between the first levels of the two source lines for the currently and the last scanned row.

5. A method for charge sharing between source lines of a pixel array, the method comprising the steps of:

grouping the source lines into pairs;

if data polarities of a currently and a last scanned row of the pixel array are different, coupling together the two source lines in each pair during a charge sharing period;

otherwise, in each pair of the source lines, estimating a common voltage level on the two source lines if the two source lines were coupled together;

estimating a first value of energy driving the voltages on the two source lines from the common voltage level to levels of data for the currently scanned row;

estimating a second value of energy driving the voltages on the two source lines from the levels of the data for the last scanned row to those for the currently scanned row; and coupling together the two source lines during the charge sharing period if the first value is smaller than the second value; and decoupling the two source lines in each pair during a data period.

6. The method as claimed in claim 5, wherein, in each source line pair, the common voltage level is estimated by averaging the levels of the data for the last scanned row.

7. The method as claimed in claim 5, wherein, in each source line pair, the first value is estimated by summation of two absolute differences respectively between the common voltage level and the two levels of the data for the currently scanned row.

8. The method as claimed in claim 5, wherein, in each source line pair, the second value is estimated by summation of two absolute differences respectively between the levels of the data for the currently and the last scanned row.

9. An apparatus for charge sharing between source lines of a pixel array in an LCD, comprising:

a plurality of switches, each of which is coupled between two of the source lines so that the source lines are grouped into pairs; and a control circuit implementing the steps of:

if data polarities of a currently and a last scanned row of the pixel array are different, closing all the switches during a charge sharing period;

otherwise, in each pair of the source lines, estimating a common voltage level of voltages on the two source lines if the switch coupled therebetween were closed;

estimating a first value of energy driving the voltages on the two source lines from the common voltage level to levels of data for the currently scanned row;

estimating a second value of energy driving the voltages on the two source lines from the levels of the data for the last scanned row to those for the currently scanned row; and closing the switch coupled between the two source lines during the charge sharing period if the first value is smaller than the second value; and opening all the switches during a data period.

10. The apparatus as claimed in claim 9, wherein, in each source line pair, the common voltage level is estimated by averaging the levels of the data for the last scanned row.

11. The apparatus as claimed in claim 9, wherein, in each source line pair, the first value is estimated by summation of two absolute differences respectively between the common voltage level and the two levels of the data for the currently scanned row.

12. The apparatus as claimed in claim 9, wherein, in each source line pair, the second value is estimated by summation of two absolute differences respectively between the levels of the data for the currently and the last scanned row.

13. The apparatus as claimed in claim 9, wherein the LCD comprises a controller and the control circuit is disposed in the controller.

14. The apparatus as claimed in claim 13, wherein the controller has a memory storing a look-up table mapping digital values to analog levels applied to the source lines for estimation of the common voltage level, and the first and second energy values.

15. The apparatus as claimed in claim 9, wherein the LCD comprises a source driver and the control circuit is disposed in the source driver.

16. A method for charge sharing between source lines of a pixel array, the method comprising the steps of:

selecting two adjacent source lines into a pair;

In the pair, estimating a common voltage level on the two source lines if the two source lines were coupled together;

estimating a first value of energy driving the voltages on the two source lines from the common voltage level to levels of data for the currently scanned row;

estimating a second value of energy driving the voltages on the two source lines from the levels of the data for the last scanned row to those for the currently scanned row; and coupling together the two source lines during the charge sharing period if the first value is smaller than the second value; and decoupling the two source lines in the pair during a data period.

17. The method as claimed in claim 16, wherein, in the pair, the common voltage level is estimated by averaging the levels of the data for the last scanned row.

18. The method as claimed in claim 16, wherein, in the pair, the first value is estimated by summation of two absolute differences respectively between the common voltage level and the two levels of the data for the currently scanned row.

19. The method as claimed in claim 16, wherein, in the pair, the second value is estimated by summation of two absolute differences respectively between the levels of the data for the currently and the last scanned row.

* * * * *